US007878559B2

(12) United States Patent
Meeks et al.

(10) Patent No.: US 7,878,559 B2
(45) Date of Patent: Feb. 1, 2011

(54) LOCK BLOCK ASSEMBLY FOR AN ASTRAGAL

(75) Inventors: James W. Meeks, Eaton, OH (US); David C. Bryant, Richmond, IN (US)

(73) Assignee: Quanex Corporation, Houston, TX (US)

( * ) Notice: Subject to any disclaimer, the term of this patent is extended or adjusted under 35 U.S.C. 154(b) by 113 days.

(21) Appl. No.: 11/690,646

(22) Filed: Mar. 23, 2007

(65) Prior Publication Data

US 2007/0205609 A1 Sep. 6, 2007

Related U.S. Application Data

(63) Continuation-in-part of application No. 11/327,056, filed on Jan. 6, 2006, now Pat. No. 7,543,860.

(60) Provisional application No. 60/642,447, filed on Jan. 7, 2005.

(51) Int. Cl.
*E05C 1/02* (2006.01)

(52) U.S. Cl. ..... 292/137; 292/138; 292/DIG. 21; 49/394

(58) Field of Classification Search ..... 292/137, 292/138, 143, 145, DIG. 21, DIG. 53, DIG. 54, 292/DIG. 38, 32, 38, 42, 302; 49/368, 367, 49/365, 394, 395; 52/211
See application file for complete search history.

(56) References Cited

U.S. PATENT DOCUMENTS

| | | | |
|---|---|---|---|
| 137,211 | A | 3/1873 | Jones |
| 3,649,060 | A | 3/1972 | Ruff |
| 3,806,175 | A | 4/1974 | Van Herpen |
| 3,944,266 | A | 3/1976 | Weaver |
| 4,052,819 | A | 10/1977 | Beischel et al. |
| 4,058,332 | A | 11/1977 | DiFazio |
| 4,429,493 | A | 2/1984 | St. Aubin |
| D273,090 | S | 3/1984 | Imperial |
| 4,573,287 | A | 3/1986 | Hagemeyer et al. |
| 4,625,457 | A | 12/1986 | Avery |

(Continued)

OTHER PUBLICATIONS

U.S. Appl. No. 11/327,056, entitled "Slide Bolt Assembly For An Astragal", filed Jan. 6, 2006, 30 pages.

(Continued)

*Primary Examiner*—Carlos Lugo
*Assistant Examiner*—Mark Williams
(74) *Attorney, Agent, or Firm*—Howard & Howard Attorneys PLLC

(57) ABSTRACT

An astragal assembly is disposed between doors of a double-door set mounted in a door frame of a building to seal between the doors. The astragal assembly includes an astragal attached to one of the doors and a lock block assembly slideable within the astragal. The astragal defines a channel and the lock block assembly includes a body slideably disposed in the channel. The lock block assembly includes a lift boot coupled to and resiliently extending from the body. The lock block assembly is slideable between an extended position and a retracted position. The lift boot includes a fin extending away from the body. The fin includes a first and second lateral portion spaced from each other and a primary portion extending from the first lateral portion to the second lateral portion for sealing against the door frame in the extended position to prevent elements from entering into the building.

32 Claims, 5 Drawing Sheets

U.S. PATENT DOCUMENTS

| | | | | |
|---|---|---|---|---|
| 4,644,696 | A | 2/1987 | Bursk | |
| 5,328,217 | A | 7/1994 | Sanders | |
| 5,350,207 | A | 9/1994 | Sanders | |
| 5,590,919 | A | 1/1997 | Germano | |
| 5,857,291 | A * | 1/1999 | Headrick | 49/368 |
| 5,943,825 | A | 8/1999 | Procton et al. | |
| 6,052,949 | A | 4/2000 | Procton et al. | |
| 6,219,971 | B1 | 4/2001 | Headrick | |
| 6,457,751 | B1 | 10/2002 | Hartman | |
| 6,491,326 | B1 | 12/2002 | Massey et al. | |
| 6,666,486 | B1 * | 12/2003 | Fleming | 292/145 |
| 2003/0052492 | A1 | 3/2003 | Massey et al. | |
| 2004/0256858 | A1 * | 12/2004 | Governale et al. | 292/1 |
| 2005/0116424 | A1 | 6/2005 | Sanders | |
| 2005/0120630 | A1 | 6/2005 | Sanders | |
| 2005/0120631 | A1 | 6/2005 | Sanders | |
| 2005/0193784 | A1 | 9/2005 | Sanders | |
| 2006/0150517 | A1 | 7/2006 | Meeks et al. | |

OTHER PUBLICATIONS

U.S. Appl. No. 11/244,786, entitled "Astragal Boot", filed Oct. 6, 2005, 24 pages.
U.S. Appl. No. 29/239,952, entitled "Astragal Boot", filed Oct. 6, 2005, 4 pages.
U.S. Appl. No. 29/239,972, entitled "Astragal Boot", filed Oct. 6, 2005, 4 pages.

* cited by examiner

LOCK BLOCK ASSEMBLY FOR AN ASTRAGAL

CROSS-REFERENCE TO RELATED APPLICATIONS

This application is a continuation-in-part application of presently pending U.S. patent application Ser. No. 11/327,056 filed Jan. 6, 2006, which claims priority to U.S. Provisional Patent Application Ser. No. 60/642,447 filed on Jan. 7, 2005, each of which are hereby incorporated by reference.

BACKGROUND OF THE INVENTION

1. Field of the Invention

The invention generally relates to an astragal assembly for disposition between a semi-active door and an active door of a double-door set mounted in a door frame. Additionally, the invention generally relates to a method of forming a lock block assembly of the astragal assembly.

2. Description of the Related Art

Various astragal assemblies are known in the art to include an astragal and a lock block assembly for sliding between a retracted position and an extended position within the astragal. The astragal assembly is disposed between an active door and a semi-active door of a double-door set mounted in a door frame. Typically, the door frame includes a threshold below the double-door set and a header above the double-door set. The astragal is mounted on a free end of a semi-active door such that the astragal moves with the free end as the semi-active door swings between an open position and a closed position. When the semi-active door is in the closed position, the lock block assembly slides within the astragal to the extended position to engage the door frame, e.g., the header or the threshold.

The lock block assembly typically includes a body slideably disposed within the astragal. A bolt generally extends from the body and the bolt engages the door frame when the lock block assembly is in the extended position. Specifically, when the lock block assembly is in the retracted position, the bolt is retracted within the astragal and the semi-active door is swingable between an open position and a closed position. When the semi-active door is in the closed position, the lock block assembly is slid within the astragal to the extended position such that the bolt extends from the astragal and engages the door frame to lock the semi-active door in the closed position.

Typically, door sweeps are mounted on a bottom edge of the semi-active door and the active door. The door sweeps seal between the bottom edge of the doors to prevent penetration of elements, e.g., water and draft, into the building. Because the astragal is disposed between the active door and the semi-active door when the doors are in the closed position, there is gap is defined between the door sweeps.

Attempts have been made to seal the gap between the door sweeps. In some configurations, the lock block assembly includes a lift boot, i.e. a sealing member, for sealing between the astragal and the threshold between the door sweeps. One such configuration is disclosed in U.S. Pat. No. 5,857,291 to Headrick, which teaches a lock block assembly including a gasket for sealing between the door sweeps. The gasket includes an outside leg that generally defines an L-shaped bottom surface. The L-shaped bottom surface conforms to the shape of the threshold to seal against the threshold. Such a lock block assembly is limited to use with particular thresholds to ensure that the L-shaped bottom surface conforms to the shape of the threshold.

It is desirable to manufacture a lock block assembly providing for improved sealing between the astragal and the door frame to prevent penetration of the elements into the building. It is also desirable to identify a method of manufacturing such an improved lock block assembly.

SUMMARY OF THE INVENTION AND ADVANTAGES

The present invention is an astragal assembly for disposition between a semi-active door and an active door of a double-door set mounted in a door frame. The astragal assembly includes an astragal defining a channel and a lock block assembly. The lock block assembly is slideable in the channel between a retracted position and an extended position. The lock block assembly includes a body slideably disposed in the channel and a lift boot coupled to and resiliently extending from the body. The body presents a distal end and the lift boot includes a fin extending away from the distal end of the body. The fin includes a first and second lateral portion spaced from each other and a primary portion extending from the first lateral portion to the second lateral portion for sealing engagement in the extended position with the door frame.

The present invention also includes a method of forming a lock block assembly of an astragal assembly. The method includes disposing the body of the lock block assembly into a cavity of a mold, the body of the lock block assembly being formed from a first material having a first durometer hardness. The method also includes introducing a second material in molten state into the cavity of the mold. The method also includes cooling the second material to form the lift boot coupled to the body wherein the second material has a second durometer hardness less than the first durometer hardness of the first material.

Accordingly, the lock block assembly is advantageous in light of the prior art. The lock block assembly is slideable along the astragal to the extended position to sealingly engage the door frame to prevent the penetration of elements, e.g., water and draft between the astragal and the door frame. Because the lift boot resiliently extends from the body, the lift boot sealingly engages the door frame in the extended position. Specifically, the first and second lateral portion and the primary portion sealingly engage the door frame in the extended position.

Additionally, the method of forming the lock block assembly is advantageous in light of the prior art. Because the second material is introduced into the cavity in the molten state and cooled, the lock block assembly is formed with the lift boot being coupled with the body. Additionally, the method provides for the formation of the lift boot and the body having different durometer hardnesses.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE INVENTION

Figure 1:
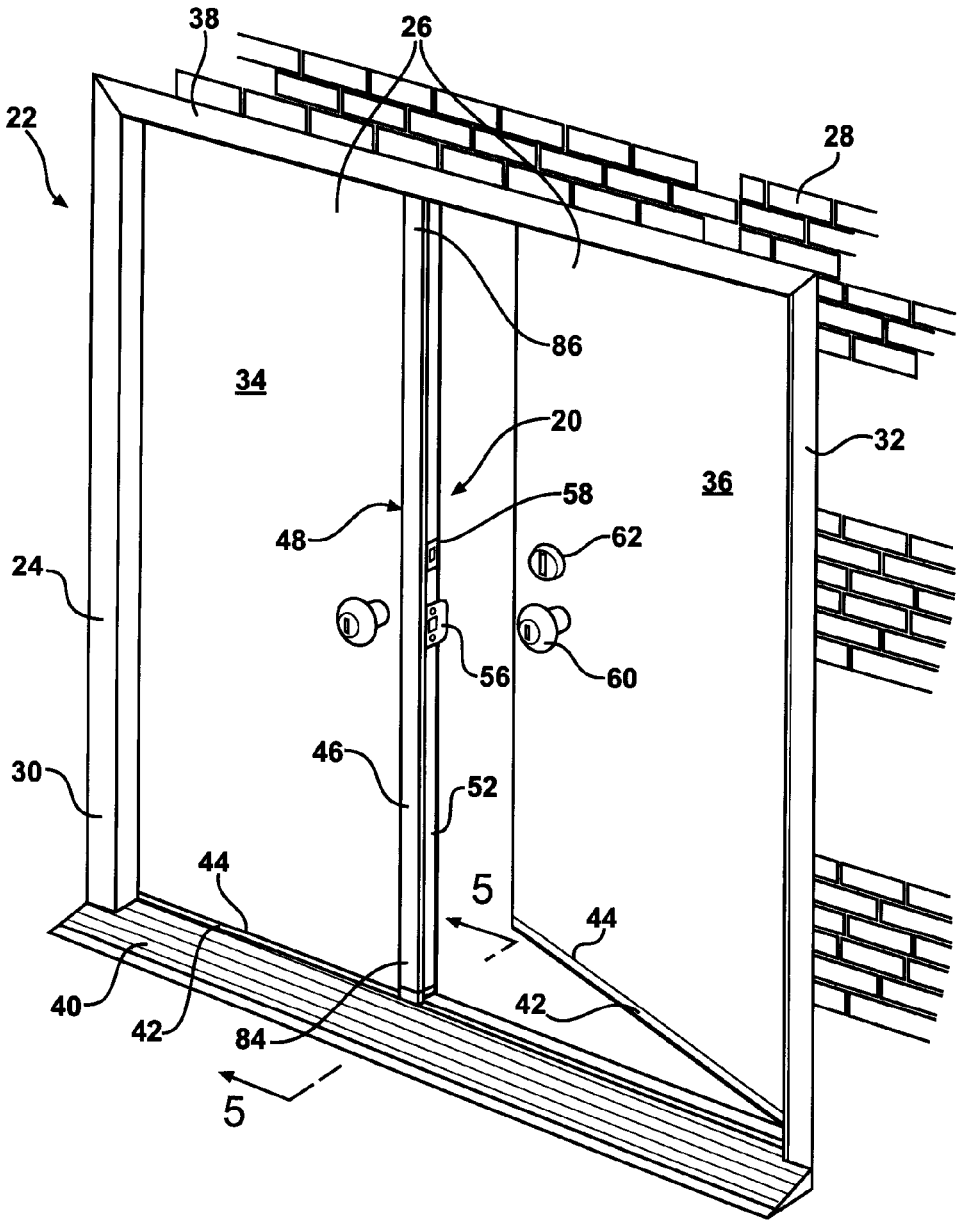
FIG. 1 is a perspective view of an astragal assembly disposed on a free end of a semi-active door of a double-door set mounted in a door frame.

Referring to the Figures, wherein like numerals indicate corresponding parts throughout the several views an astragal assembly 20 is generally shown. As shown in FIG. 1, the astragal assembly 20 is mounted in a door assembly 22.

The door assembly 22 includes a door frame 24 and a double-door set 26 mounted to the door frame 24. Specifically, the door frame 24 may be mounted in a door opening of a building 28 such as a commercial or a residential building 28. In such a configuration, the door frame 24 includes a first and second vertical member 30, 32 spaced from and generally in parallel with each other. The double-door set 26 includes a semi-active door 34 rotatably mounted to the first vertical member 30 of the door frame 24 and an active door 36 rotatably mounted to the second vertical member 32 of the door frame 24. The semi-active door 34 and the active door 36 rotate relative to the first vertical member 30 and the second vertical member 32, respectively, such that the doors 34, 36 are independently swingable between an open position and a closed position. The door frame 24 also includes a header 38 extending between the first and second vertical members 30, 32 above the double-door set 26 and a threshold 40 extending between the first and second vertical members 30, 32 below the double-door set 26.

Each door includes a door sweep 42 with each door sweep 42 mounted on a bottom edge 44 of the respective door. The header 38 may include horizontal weather strips disposed between the header 38 and each of the doors 34, 36. The door sweeps 42 seal between the bottom edge 44 of the doors 34, 36 and the threshold 40 and the horizontal weather strips seal between the top edge of the doors 34, 36 and the header 38 to prevent penetration of elements, e.g., water and draft, into the building 28.

The astragal assembly 20 is disposed between the semi-active door 34 and the active door 36 of the double-door set 26 mounted in the door frame 24. The astragal 46 is be attached to a free end 48 of the semi-active door 34 such that the astragal 46 moves with the free end 48 when the semi-active door 34 is swung between the open position and the closed position. For example, as shown in FIG. 2, the astragal 46 presents walls defining a pair of opposing fingers 50 that engage the semi-active door 34 to attach the astragal 46 to the free end 48 of the semi-active door 34.

Figure 2:
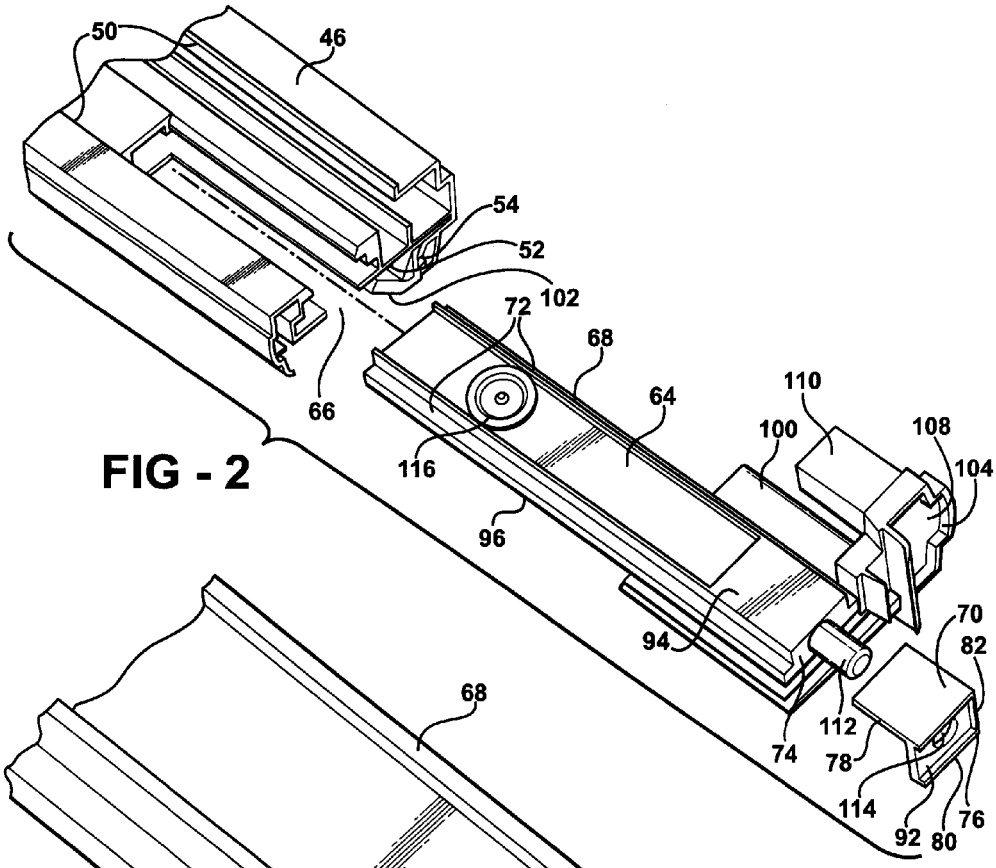
FIG. 2 is an exploded perspective view of a portion of the astragal assembly including a lock block assembly having a body and a lift boot.

As shown in FIGS. 1 and 2, the astragal 46 presents a first inside surface 52 and a second inside surface 54 perpendicular to and extending from the first inside surface 52 such that a corner of the active door 36 abuts the first inside surface 52 and the second inside surface 54 when the active door 36 and the semi-active door 34 are in the closed position. For example, as shown in FIG. 1, a strike plate 56 and a deadbolt strike 58 is mounted on the first inside surface 52 of the astragal 46. In such a configuration, the strike plate 56 is aligned along the first inside surface 52 to receive a latch from a door knob assembly 60 on the active door 36 when the active door 36 and the semi-active door 34 are in the closed position. When both the active door 36 and the semi-active door 34 are in the closed position, the latch from the door knob assembly 60 engages the strike plate 56 on the semi-active door 34 to engage the active door 36 and the semi-active door 34. A door knob on the door knob assembly 60 may be turned to disengage the latch from the strike plate 56 thereby disengaging the active door 36 from the semi-active door 34. Likewise, the deadbolt strike 58 is aligned along the first inside surface 52 to receive a deadbolt from a deadbolt assembly 62 on the active door 36 when the active door 36 and the semi-active door 34 are in the closed position and the deadbolt is in a locked position.

Figure 5:
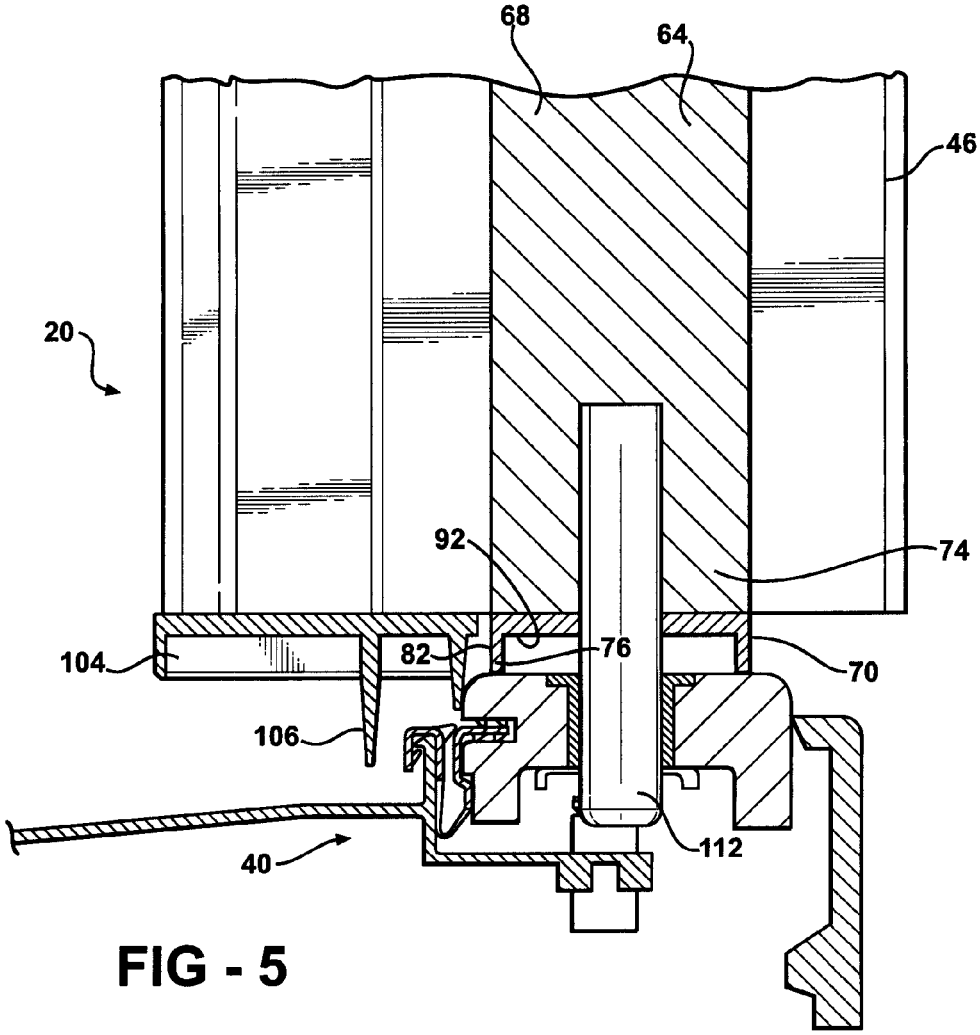
FIG. 5 is a cross-sectional view of the astragal assembly along line 5 of FIG. 1.

The astragal assembly 20 includes an astragal 46 and a lock block assembly 20, 64. As shown in FIG. 2, the astragal 46 defines a channel 66 and the lock block assembly 64 is slideably disposed in the channel 66. Specifically, the lock block assembly 64 is slideable between a retracted position and an extended position along the channel 66 of the astragal 46. FIG. 5 shows the lock block assembly 64 in the engaged position with the threshold 40.

The lock block assembly 64 includes a body 68 slideably disposed along the channel 66 of the astragal 46 and a lift boot 70 coupled to and resiliently extending from the body 68. In other words, the lift boot 70 bends without permanent deformation. For example, the body 68 may present a pair of lateral rails 72 corresponding in shape with the channel 66 of the astragal 46 for slideable disposition in the channel 66 between the retracted position and the extended position.

Figure 4:
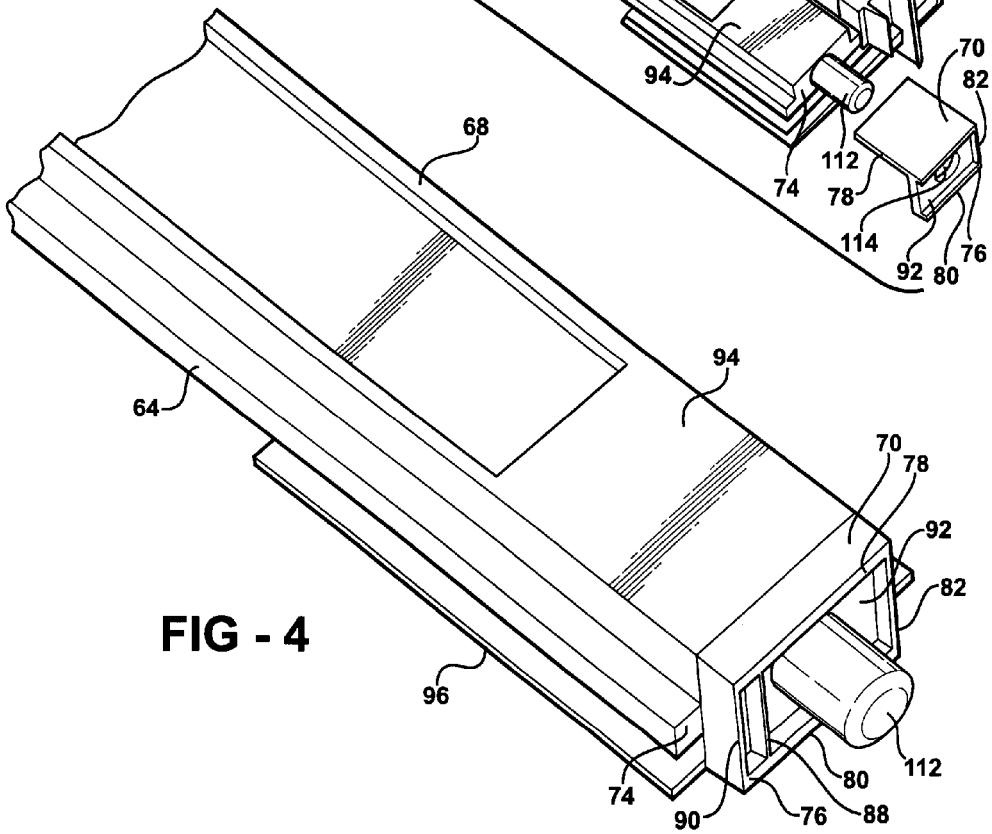
FIG. 4 is a perspective view of a portion of the astragal assembly including another embodiment of the lift boot.
Figure 3A:
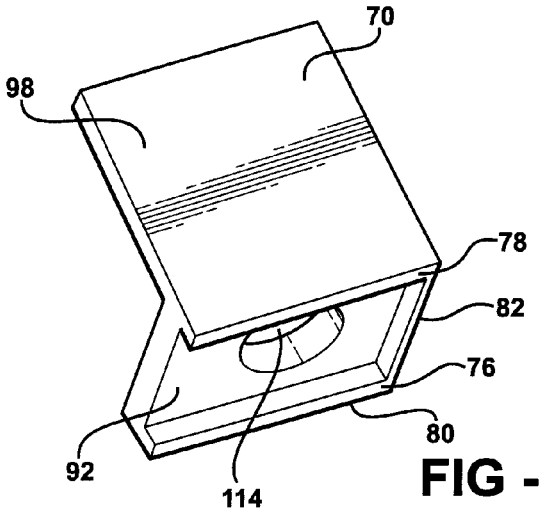
FIG. 3A is a perspective view of the lift boot.

The body 68 includes a distal end 74 and the lift boot 70 is coupled to and resiliently extends from the distal end 74. As shown in FIGS. 2-4, the lift boot 70 includes a fin 76 extending away from the distal end 74.

The fin 76 includes a first and second lateral portion 78, 80 spaced from each other and a primary portion 82 extending from the first lateral portion 78 to the second lateral portion 80 for selectively sealingly engaging the door frame 24, e.g., the threshold 40 or the header 38. In other words, the primary portion 82 extends from the first lateral portion 78 to the second lateral portion 80 for sealing engagement in the extended position with the door frame 24. FIG. 5 shows the primary portion 82 in sealing engagement with the threshold 40. Because the lift boot 70 resiliently extends from the body 68, the lift boot 70 conforms to the shape of the door frame 24 to sealingly engage the door frame 24. Specifically, the lateral portions 78, 80 and the primary portion 82 of the fin 76 bend conform to the shape of the door frame 24 to sealingly engage the door frame 24. For example, because the lateral and primary portions 82 bend, the lateral and primary portions 82 conform to a variety of shapes and therefore may seal to different thresholds of varying shapes.

It should be appreciated that the lock block assembly 64 may be positioned at a lower end 84 of the astragal 46. In such a configuration the lock block assembly 64 is slideable downwardly from the retracted position to the extended position to sealingly engage the fin 76 with the threshold 40. Alternatively, it should be appreciated that the lock block assembly 64 may be positioned at an upper end 86 of the astragal 46. In such a configuration, the lock block assembly 64 is slideable upwardly from the retracted position to the extended position to sealingly engage the fin 76 with the header 38.

When the lock block assembly 64 is positioned at the lower end 84 of the astragal 46 and when the doors 34, 36 are in the closed position and the lock block assembly 64 is in the extended position, the lock block assembly 64 seals the astragal 46 to the threshold 40 and the door sweeps 42 seal the doors 34, 36 to the threshold 40. In other words, the lock block assembly 64 and the door sweeps 42 in combination prevent the elements from passing over the threshold 40 and into the building 28. When the lock block assembly 64 is positioned at the upper end 86 of the astragal 46 and when the doors 34, 36 are in the closed position and the lock block assembly 64 is in the extended position, the lock block assembly 64 seals the astragal 46 to the header 38 and the horizontal weather strips seal the doors 34, 36 to the header 38. In other words, the lock block assembly 64 and the horizontal weather strips in combination prevent the elements from passing under the header 38 into the building 28.

Advantageously, the lock block assembly 64 may be moved to the retracted position before the semi-active is swung between the open position and the closed position. In the retracted position the lift boot 70 is spaced from the door frame 24 and as such, the fin 76 does not slide across the door frame 24 when the semi-active door 34 is moved between the open position and the closed position. Sliding across the door frame 24 may cause wear on the fin 76 and as such the lift boot 70 is moved to the retracted position to avoid such wear.

Figure 3B:
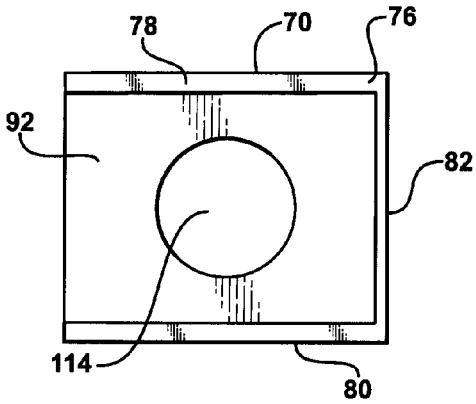
FIG. 3B is a bottom view of the lift boot.
Figure 3C:
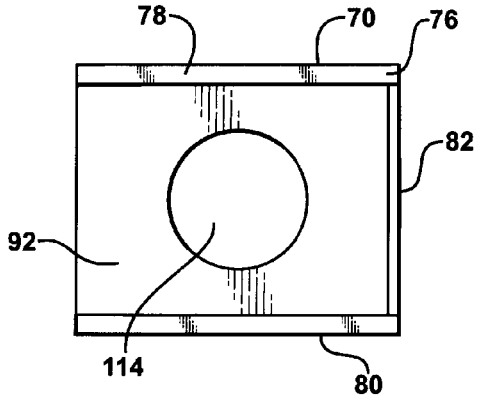
FIG. 3C is a bottom view of another embodiment of the lift boot.

The primary portion 82 of the fin 76 may be joined to the first and second lateral portions 78, 80 of the fin 76. In other words, the primary portion 82 may be continuous with the lateral portions 78, 80. Alternatively, as shown in FIG. 3C, the primary portion 82 is discontinuous with the lateral portions 78, 80 but still adjacent to and in contact with the lateral portions 78, 80. For example, in such a configuration the primary portion 82 may be tightly pressed against the lateral portions 78, 80.

The primary portion 82 of the fin 76 may extend a further distance from the distal end 74 than the first and second lateral portions 78, 80. In such a configuration, the primary portion 82 flexes against the door frame 24 when the lock block assembly 64 is in the extended position. Because the primary portion 82 extends from the first lateral portion 78 to the second lateral portion 80, the lateral portions 78, 80 hold the primary portion 82 in contact with the threshold 40. The primary portion 82 may be thinner than the first and second lateral portions 78, 80. In such a configuration, because the primary portion 82 is thinner than the lateral portions 78, 80, the primary portion 82 flexes against the door frame 24.

As shown in FIGS. 4 and 5, the fin 76 may include a plurality of primary portions 82. The plurality of primary portions 82 are spaced from each other and extend from the first lateral portion 78 to the second lateral portion 80. Specifically, as shown in FIG. 5, the fin 76 includes a pair of primary portions 82. As shown in FIG. 4, the fin 76 includes a second primary portion 88 and a third primary portion 90. The second primary portion 88 is spaced from the primary portion 82 and the third primary portion 90 and extends from the first lateral portion 78 to the second lateral portion 80. Likewise, the third primary portion 90 is spaced from the primary portion 82 and the second primary portion 88 and extends from the first lateral portion 78 to the second lateral portion 80.

In such a configuration, if the primary portion 82 of the fin 76 becomes worn or obstructed, then elements can penetrate between the primary portion 82 and the door frame 24 but will be prevented from penetrating into the building 28 by the second primary portion 88 of the fin 76. Likewise, if both the primary portion 82 and the second primary portion 88 are worn or obstructed then the elements that can penetrate below the primary portion 82 and the second primary portion 88 is prevented from penetrating into the building 28 by the third primary portion 90. Each of the plurality of primary portions 82 increases the likelihood of prevention of penetration of the elements between the astragal 46 and the door frame 24 and into the building 28.

It should be appreciated that the primary portion 82 of the fin 76 may have any shape or configuration. For example, the primary portion 82 may include a hub portion and a plurality of leg portions each extending from the hub to the first or second lateral portion 78, 80.

The lift boot 70 may include a platform 92 coupled to the distal end 74 of the body 68 with the fin 76 extending from the platform 92. Specifically, the first and second lateral portions 78, 80 and the primary portion 82 extend from the platform 92. The fin 76 is integral with the platform 92. In other words, the platform 92 and the fin 76 is formed as a single unit. Alternatively, the platform 92 and the fin 76 is formed separately and subsequently coupled together. For example, in such a configuration, the platform 92 and the fin 76 could be glued, welded, and/or melted together.

The body 68 may be formed from a first material and the lift boot 70 may be formed from a second material. The first material is different than the second material. Specifically, the body 68 may be formed of a polymer and the lift boot 70 may be formed of an elastomer. For example, the body 68 is formed of a hard plastic such as polypropylene and the lift boot 70 is formed of rubber, such as a synthetic or naturally occurring rubber, or a thermoplastic elastomer, such as that commercially available from ExxonMobil Chemical under the tradename Santoprene™.

The first material has a first durometer hardness and the second material has a second durometer hardness less than the first durometer hardness. In other words, the body 68 has a first durometer hardness and the lift boot 70 has a second durometer hardness with the second durometer hardness less than the first durometer hardness. Specifically, the first durometer hardness is between 55 and 85 Shore D and the second durometer hardness is between 25 and 45 Shore A. More preferably, the first durometer hardness is 72 Shore D and the second durometer hardness is 35 Shore A. In such a configuration, the lift boot 70 is more flexible than the body 68. Specifically, the body 68 is rigid for sliding in the channel 66 of the astragal 46 and the lift boot 70 is flexible to sealingly engage the door frame 24 in the extended position.

The lift boot 70 may be formed separately from the body 68 and subsequently secured to the body 68. In such a configuration, for example, the lift boot 70 assembly includes an adhesive disposed between and adhered to the lift boot 70 and the body 68. However, it should be appreciated that the lift boot 70 may be secured to the body 68 in any fashion without departing from the nature of the present invention.

Alternatively, the lift boot 70 is integral with the body 68. In other words, the lift boot 70 and the body 68 are formed as a single unit.

The body 68 presents a first side 94 extending from the distal end 74 for disposition facing the semi-active door 34 and a second side 96 extending from the distal end 74 for disposition facing the active door 36. In other words, the body 68 extends between the first and second sides 94, 96 and the first and second sides 94, 96 each extend vertically from the distal end 74. The lift boot 70 may include a sealing pad 98 extending along the first side 94 for sealing against the first side 94 of the body 68 and the semi-active door 34. In a configuration in which the lift boot 70 includes the platform 92, the sealing pad 98 extends from the platform 92. In such a configuration, as shown in FIGS. 2-3B, the lift boot 70 is generally L-shaped.

The lock block assembly 64 may include a corner pad 100 secured to the second side 96 for sealing against the second side 96 and the active door 36 when the semi-active door 34 and the active door 36 are in a closed position. A vertical weather strip 102 extends along the second inside surface 54 of the astragal 46. Preferably, an end user, such as an installer, attaches the corner pad 100 to the lock block assembly 64. More specifically, double-sided tape or an adhesive is disposed on the corner pad 100 and a backing may be disposed on the double-sided tape or adhesive. The end user removes the backing, flips a free portion of the vertical weather strip 102 over the corner pad 100, and applies pressure to the corner pad 100 to adhere the corner pad 100 to the lock block assembly 64. When the semi-active door 34 and the active door 36 are in the closed position, the corner pad 100 and the vertical weather strip 102 prevent the elements from penetrating between the active door 36 and the astragal 46.

As shown in FIG. 2, the astragal assembly 20 may further include a bottom boot 104 coupled to the astragal 46. The bottom boot 104 includes a resilient boot fin 106 for sealing engagement with the door frame 24 when the semi-active door 34 is in a closed position. In such a configuration, the bottom boot 104 is positioned on an exterior side of the door assembly 22 relative to the lift boot 70. The bottom boot 104 includes a base 108 and includes a projection 110 extending from the base 108 corresponding in shape with the profile of the astragal 46 for engaging the walls of the astragal 46. The projection 110 may be tapered such that the projection 110 is press fit into the profile against the walls of the astragal 46. The projection 110 may be cross-shaped and upwardly tapering such that the projection 110 engages the walls of the astragal 46. The bottom boot 104 is removable from the astragal 46 such that the bottom boot 104 replaceable if the bottom boot 104 becomes damaged or worn.

The resilient boot fin 106 is flexible and projects from the base 108 for overlapping sealing engagement with the door sweeps 42. In such a configuration, when the doors are in the closed position, the resilient boot fin 106 extends between and overlaps the door sweeps 42.

The resilient boot fin 106 reduces or prevents elements from penetrating between the astragal 46 boot and the threshold 40 into the building 28. Because the resilient boot fin 106 is flexible, water can leak past the resilient boot fin 106. In addition, due to the flexibility of the resilient boot fin 106, it is possible for the resilient boot fin 106 to be obstructed by debris thereby preventing a water-tight seal against the door frame 24 and allowing water to leak past the resilient boot fin 106. As discussed above, the fin 76 of the lift boot 70 prevents further penetration of elements that penetrate between the resilient boot fin 106 and the threshold 40 from penetrating below the lock block assembly 64 and into the building 28.

The body 68 may include a bolt 112 extending from the distal end 74 of the body 68. In such a configuration, the platform 92 defines an aperture 114 with the bolt 112 extending through the aperture 114 for engagement with the door frame 24 in the extended position. The bolt 112 is integral with or an attachment to the body 68. The bolt 112 is formed from any type of rigid material, preferably metal, and more preferably steel.

The door frame 24, e.g., the threshold 40 and/or the header 38, may include a keeper 41 defining an orifice. When the semi-active door 34 is in the closed position, the lock block assembly 64 is slideable to the extended position to engage the keeper 41. The semi-active door 34 does not rotate relative to the threshold 40 when the lock block assembly 64 is slid to the extended position and engaged with the keeper 41. In the retracted position, the bolt 112 is disengaged from the keeper 41 and the semi-active door 34 is rotatable relative to the door frame 24. In such a configuration, the lock block assembly 64 in the both locks the semi-active door 34 in place relative to the door frame 24 and, as discussed above, seals between the astragal 46 and the door frame 24 to prevent the penetration of the elements between the astragal 46 and the door frame 24.

The lock block assembly 64 may include a locking device 116 for selectively maintaining the lock block assembly 64 in the extended position or the retracted position. For example, such a locking device 116 is a screw lock such as that disclosed in the U.S. patent application Ser. No. 11/327,056 to Meeks et al., which is hereby incorporated by reference.

Figure 6:
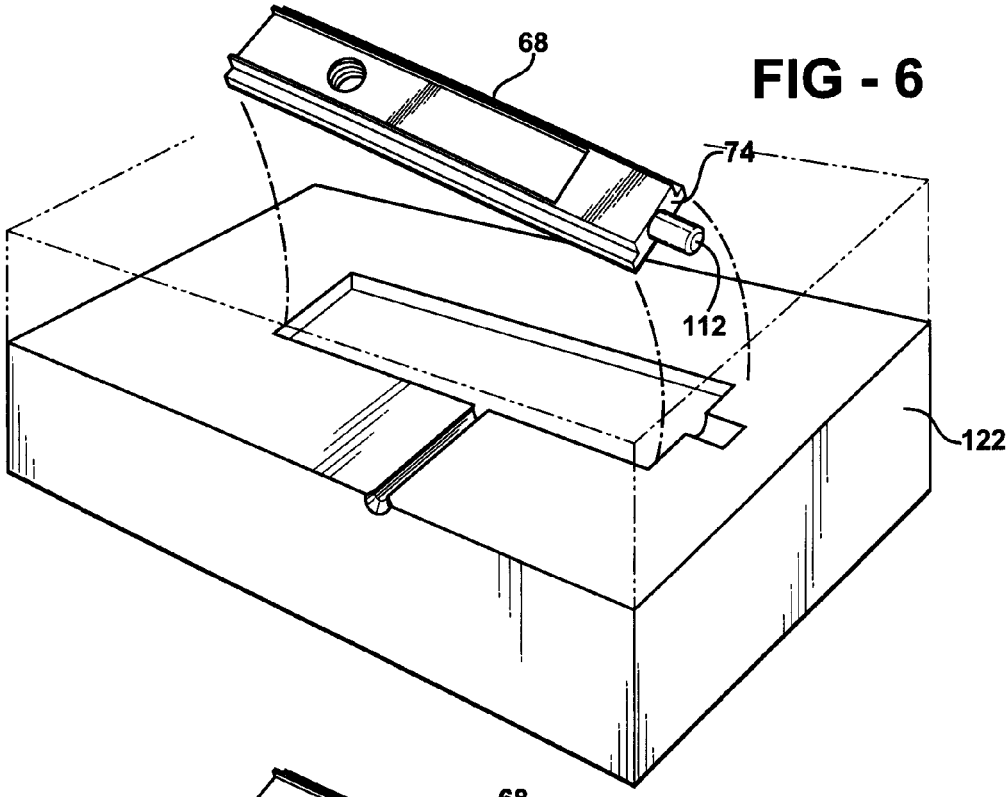
FIG. 6 is a perspective view of a mold for forming the lock block assembly.

The invention further includes a method of forming the lock block assembly 64 of the astragal assembly 20. As shown in FIG. 6, the method utilizes a mold 118 defining a cavity 120. For example, the mold 118 is an injection mold. However, it should be appreciated that the mold 118 may be any type of mold without departing from the nature of the present invention.

Figure 7:
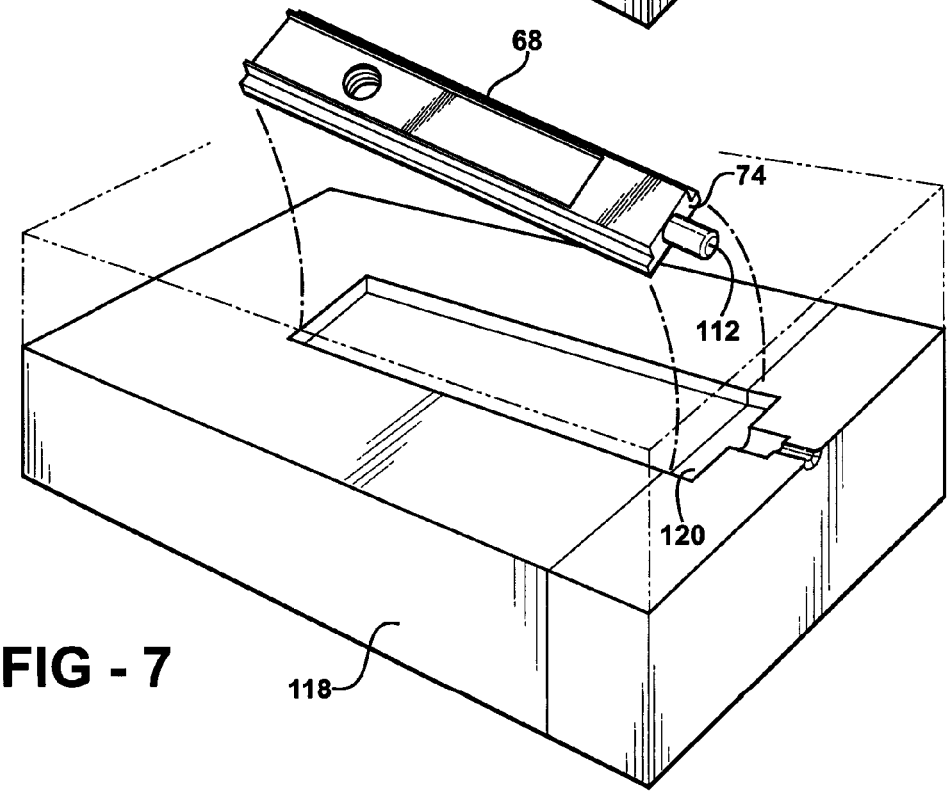
FIG. 7 is a perspective view of a body-forming mold for forming a body of the lock block assembly.

The method includes disposing the body 68 of the lock block assembly 64 into the cavity 120 of the mold 118 as shown in FIG. 7. As stated above, the body 68 of the lock block assembly 64 is formed from the first material having the first durometer hardness.

The method further includes introducing the second material in molten state into the cavity 120 of the mold 118 and cooling the second material to form the lift boot 70 coupled to the body 68. The steps of disposing the body 68 in mold 118 and introducing the second material in molten state may be referred to by one skilled in the art as overmolding. In other words, the lift boot 70 is overmolded onto the body 68.

As stated above the second material has the second durometer hardness less than the first durometer hardness of the first material. Specifically, the lift boot 70, upon the cooling of the second material, is coupled to the distal end 74 of the body 68. In the configuration wherein the lift boot 70 includes the sealing pad 98, upon the cooling of the second material, the sealing pad 98 is coupled to the first side 94 of the body 68.

The second material is introduced into the cavity 120 and into contact with the distal end 74 of the body 68. Alternatively, the second material may contact the distal end 74 while the second material cools. Because the second material is in the molten state, heat is transferred from the second material to the body 68 to soften and/or melt a surface of the body 68. In other words, contact between the body 68 and the second material in molten state creates a melted interface between the body 68 and the second material. Upon cooling the second material and the melted interface solidify such that the body 68 and the lift boot 70 are integral with each other. The second material is introduced about a portion of the bolt 112 such that the aperture 114 is defined by the lift boot 70 about the bolt 112 when the second material is cooled.

For example, as shown in FIG. 6, the method may utilize a body-forming mold 122 to form the body 68. For example, the body-forming mold 122 is an injection mold. However, it should be appreciated that the body-forming mold 122 may any type of mold without departing from the nature of the present invention.

The method may include coupling the bolt 112 to the body 68 prior to disposing the body 68 into the cavity 120 of the mold 118. Specifically, the method includes disposing the bolt 112 in the body-forming mold 122 and introducing the first material in molten state into the body-forming mold 122 to form the body 68 coupled to the bolt 112 prior to disposing the body 68 into the cavity 120 of the mold 118. When the first material is cooled, the first material becomes solidified to form the body 68 such that the first material and the bolt 112 are integral. For example, the bolt 112 may have features for engaging the body 68 when the first material is solidified such that the bolt 112 remains engaged with the body 68.

Alternatively, the body 68 is formed separate from and subsequently coupled with the bolt 112. For example, the body 68 and the bolt 112 is correspondingly configured such that the body 68 and the bolt 112 are engaged with each other.

In an alternative to the body-forming mold 122, the body 68 is formed in the mold 118. For example, the first material is introduced into the mold 118 and solidified prior to the introduction of the second material into the mold 118. Alternatively, the first material and the second material are both in the molten state at the mold 118 at the same time and solidified together.

As stated above, the first material may be a polymer and the second material may be an elastomer. In such a configuration, introducing the second material into the cavity 120 includes introducing the elastomer into the cavity 120 wherein upon cooling the elastomer is coupled to the polymer.

The cavity 120 of the mold 118 is configured such that the lift boot 70 being formed upon the cooling of the second material includes the fin 76 having the first and second lateral portion spaced from each other and the primary portion 82 extending from the first portion to the second portion. Further, the cavity 120 of the mold 118 is configured such that upon cooling, the fin 76 has the plurality of primary portions 82 such as, for example, the second and third primary portions 88, 90.

The invention has been described in an illustrative manner, and it is to be understood that the terminology which has been used is intended to be in the nature of words of description rather than of limitation. Obviously, many modifications and variations of the present invention are possible in light of the above teachings, and the invention may be practiced otherwise than as specifically described.

What is claimed is:

1. A lock block assembly for sliding between a retracted position and an extended position along a channel of an astragal disposed between a semi-active door and an active door of a double-door set mounted in a door frame, said lock block assembly comprising:

a body for slideable disposition along the channel of the astragal and including a distal end;

a lift boot coupled to and resiliently extending from said distal end of said body and including a fin extending away from said distal end of said body;

said fin including a first and second lateral portion spaced from each other defining a cavity therebetween and a primary portion extending across said cavity from said first lateral portion to said second lateral portion so that said first lateral portion, said second lateral portion, and said primary portion resiliently bend for conforming to seal against the door frame in the extended position;

wherein said lift boot includes a platform coupled to said distal end of said body with said first lateral portion, said second lateral portion, and said primary portion coupled to and extending from said platform defining said cavity between said first lateral portion, said second lateral portion, said primary portion, and said platform; and wherein said platform defines an aperture between said first lateral portion, said second lateral portion and said primary portion for receiving a bolt that engages the door frame in the extended position.

2. The lock block assembly as set forth in claim 1 wherein said primary portion of said fin is joined to said first and second lateral portions of said fin.

3. The lock block assembly as set forth in claim 1 wherein said fin includes a second primary portion spaced from said primary portion and extending from said first lateral portion to said second lateral portion defining said cavity between said first lateral portion, said second lateral portion, said primary portion, and said second primary portion.

4. The lock block assembly as set forth in claim 1 wherein said body is formed of a polymer and said lift boot is formed of an elastomer.

5. The lock block assembly as set forth in claim 1 wherein said body has a first durometer hardness and said lift boot has a second durometer hardness with said second durometer hardness less than said first durometer hardness.

6. The lock block assembly as set forth in claim 1 further including an adhesive disposed between and adhered to said lift boot and said body.

7. The lock block assembly as set forth in claim 1 wherein said lift boot is integral with said body.

8. The lock block assembly as set forth in claim 1 wherein said body presents a first side extending from said distal end for disposition facing the semi-active door and wherein said lift boot includes a sealing pad integral with said platform and extending from said platform along said first side for sealing against said first side of said body and the semi-active door.

9. The lock block assembly as set forth in claim 8 wherein said body presents a second side extending from said distal end for disposition facing the active door and further including a corner pad secured to said second side for sealing against said second side and the active door of the double-door set when the semi-active door and the active door are in a closed position.

10. The lock block assembly as set forth in claim 9 wherein said first side is parallel to said second side.

11. The lock block assembly as set forth in claim 8 wherein said sealing pad is integral with said first lateral fin with said sealing pad and said first lateral fin extending in opposite directions from said platform.

12. The lock block assembly as set forth in claim 11 wherein said sealing pad and said first lateral fin define a planar surface for sealing against the semi-active door.

13. The lock block assembly as set forth in claim 1 wherein said body presents a second side extending from said distal end for disposition facing the active door and further including a corner pad secured to said second side for sealing against said second side and the active door of the double-door set when the semi-active door and the active door are in a closed position.

14. An astragal assembly for disposition between a semi-active door and an active door of a double-door set mounted in a door frame, said astragal assembly comprising:

an astragal defining a channel;

a lock block assembly slideable in said channel between a retracted position and an extended position, said lock block assembly including a body slideably disposed in said channel and a lift boot coupled to and resiliently extending from said body with said body presenting a distal end and with said lift boot including a fin extending away from said distal end of said body;

said fin including a first and second lateral portion spaced from each other defining a cavity therebetween and a primary portion extending across said cavity from said first lateral portion to said second lateral portion so that said first lateral portion, said second lateral portion, and said primary portion resiliently bend to conform to seal against the door frame in said extended position;

wherein said lift boot includes a platform coupled to said distal end of said body with said first lateral portion, said second lateral portion, and said primary portion extending from said platform defining said cavity between said first lateral portion, said second lateral portion, said primary portion, and said platform; and wherein said lock block assembly includes a bolt extending from said distal end and wherein said platform defines an aperture between said first lateral portion, said second lateral portion, and said primary portion with said bolt extending through said aperture for engagement with the door frame in the extended position.

15. The astragal assembly as set forth in claim 14 wherein said primary portion of said fin is joined to said first and second lateral portions of said fin.

16. The astragal assembly as set forth in claim 14 wherein said fin includes a second primary portion spaced from said primary portion and extending from said first lateral portion to said second lateral portion defining said cavity between said first lateral portion, said second lateral portion, said primary portion, and said second primary portion.

17. The astragal assembly as set forth in claim 14 wherein said body is formed of a polymer and said lift boot is formed of an elastomer.

18. The astragal assembly as set forth in claim 14 wherein said body has a first durometer hardness and said lift boot has a second durometer hardness with said second durometer hardness less than said first durometer hardness.

19. The astragal assembly as set forth in claim 14 further including a bottom boot coupled to said astragal and including a resilient boot fin for sealing engagement with the door frame when the semi-active door is in a closed position.

20. The astragal assembly as set forth in claim 14 wherein said lock block assembly includes an adhesive disposed between and adhered to said lift boot and said body.

21. The astragal assembly as set forth in claim 14 wherein said lift boot is integral with said body.

22. The astragal assembly as set forth in claim 14 wherein said body presents a first side extending from said distal end for disposition facing the semi-active door and wherein said lift boot includes a sealing pad integral with said platform and extending from said platform along said first side for sealing against the first side of said body and the semi-active door.

23. The astragal assembly as set forth in claim 22 wherein said body presents a second side extending from said distal end for disposition facing the active door and further including a corner pad secured to said second side for sealing against said second side and an active door when the semi-active door and the active door are in a closed position.

24. The astragal assembly as set forth in claim 23 wherein said first side is parallel to said second side.

25. The astragal assembly as set forth in claim 22 wherein said sealing pad is integral with said first lateral fin with said sealing pad and said first lateral fin extending in opposite directions from said platform.

26. The lock block assembly as set forth in claim 25 wherein said sealing pad and said first lateral fin define a planar surface for sealing against the semi-active door.

27. The astragal assembly as set forth in claim 14 wherein said body presents a second side extending from said distal end for disposition facing the active door and further including a corner pad secured to said second side for sealing against said second side and an active door when the semi-active door and the active door are in a closed position.

28. The astragal assembly as set forth in claim 14 wherein said lift boot and said bolt are fixed relative to said body to move together as a unit as said lock block assembly is slid between the retracted position and the extended position.

29. A combination comprising:

a threshold for disposition below a semi-active door and an active door; and an astragal assembly for disposition between the semi-active door and the active door, said astragal assembly comprising:

an astragal defining a channel;

a lock block assembly slideable in said channel between a retracted position spaced from said threshold and an extended position engaging said threshold, said lock block assembly including a body slideably disposed in said channel and a lift boot coupled to and resiliently extending from said body with said body presenting a distal end and with said lift boot including a fin extending away from said distal end of said body;

said fin including a first and second lateral portion spaced from each other defining a cavity therebetween and a primary portion extending across said cavity from said first lateral portion to said second lateral portion with said first lateral portion, said second lateral portion, and said primary portion resiliently bent in said extended position to conform to seal against said threshold.

30. The combination as set forth in claim 29 wherein said fin includes a second primary portion spaced from said primary portion and extending from said first lateral portion to said second lateral portion defining said cavity between said first lateral portion, said second lateral portion, said primary portion, and said second primary portion wherein said second primary portion seals against said threshold in said extended position.

31. The combination as set forth in claim 29 wherein said lock block assembly includes a bolt extending from said distal end and wherein said platform defines an aperture between said first lateral portion, said second lateral portion, and said primary portion with said bolt extending through said aperture and engaging said threshold in the extended position.

32. The combination as set forth in claim 29 wherein said lift boot includes a platform coupled to said distal end of said body with said first lateral portion, said second lateral portion, and said primary portion extending from said platform defining said cavity between said first lateral portion, said second lateral portion, said primary portion, and said platform and wherein said platform is spaced from said threshold in said extended position.

* * * * *